US010655920B2

(12) United States Patent
Espersen et al.

(10) Patent No.: US 10,655,920 B2
(45) Date of Patent: May 19, 2020

(54) THERMOSIPHON WITH BENT TUBE SECTION

(71) Applicant: Aavid Thermalloy, LLC, Laconia, NH (US)

(72) Inventors: Morten Søegaard Espersen, Bologna (IT); Maria Luisa Angrisani, Bologna (IT); Dennis N. Jensen, Bologna (IT); Sukhvinder S. Kang, Concord, NH (US)

(73) Assignee: Aavid Thermalloy, LLC, Laconia, NH (US)

( * ) Notice: Subject to any disclaimer, the term of this patent is extended or adjusted under 35 U.S.C. 154(b) by 280 days.

(21) Appl. No.: 14/850,002

(22) Filed: Sep. 10, 2015

(65) Prior Publication Data

US 2016/0076819 A1 Mar. 17, 2016

Related U.S. Application Data

(60) Provisional application No. 62/050,463, filed on Sep. 15, 2014.

(51) Int. Cl.
*F28D 15/02* (2006.01)

(52) U.S. Cl.
CPC ..... *F28D 15/0266* (2013.01); *F28D 15/0233* (2013.01)

(58) Field of Classification Search
CPC ..... F28D 15/0266; F28D 15/0233
USPC ..... 165/104.21
See application file for complete search history.

(56) References Cited

U.S. PATENT DOCUMENTS

| | | | | |
|---|---|---|---|---|
| 3,658,075 | A | 4/1972 | Jacobs | |
| 4,830,100 | A | 5/1989 | Kato et al. | |
| 4,921,041 | A | 5/1990 | Akachi | |
| 5,185,925 | A | 2/1993 | Ryan et al. | |
| 5,713,413 | A | 2/1998 | Osakabe et al. | |
| 5,737,923 | A | 4/1998 | Gilley et al. | |
| 6,073,683 | A | 6/2000 | Osakabe et al. | |
| 7,957,132 | B2 * | 6/2011 | Fried | F28D 15/0266 165/185 |
| 2005/0205129 | A1 | 9/2005 | Karalis et al. | |
| 2005/0205239 | A1 | 9/2005 | Take | |

(Continued)

FOREIGN PATENT DOCUMENTS

| | | | |
|---|---|---|---|
| CN | 102997728 | A | 3/2013 |
| CN | 103096693 | A | 5/2013 |

(Continued)

OTHER PUBLICATIONS

English translation of Showa Aluminum Corp. (JPH09133482).*

(Continued)

*Primary Examiner* — Joel M Attey
(74) *Attorney, Agent, or Firm* — Wolf, Greenfield & Sacks, P.C.

(57) ABSTRACT

A thermosiphon device including one or more multi-port tubes that form both an evaporator section and a condenser section for the device. The one or more tubes may be flat tubes with multiple, parallel flow channels, and may be bent to form a bend between the evaporator and condenser sections of the tube(s). One or more flow channels of the tube at the bend may provide a vapor flow path or a liquid flow path between the evaporator and condenser sections.

16 Claims, 12 Drawing Sheets

(56) References Cited

U.S. PATENT DOCUMENTS

| | | | | |
|---|---|---|---|---|
| 2006/0266499 | A1 | 11/2006 | Choi et al. | |
| 2007/0163754 | A1 | 7/2007 | Dionne | |
| 2009/0056916 | A1 | 3/2009 | Yesin et al. | |
| 2012/0186785 | A1* | 7/2012 | Dinh | F24F 12/002 165/104.21 |
| 2012/0267088 | A1* | 10/2012 | Lange | F28D 15/0275 165/181 |
| 2013/0104592 | A1 | 5/2013 | Cottet et al. | |
| 2014/0014303 | A1 | 1/2014 | Rice et al. | |

FOREIGN PATENT DOCUMENTS

| | | | |
|---|---|---|---|
| EP | 2031332 | A1 | 3/2009 |
| EP | 2246653 | A1 | 11/2010 |
| EP | 2327947 | A1 | 6/2011 |
| JP | S55-155189 | A | 12/1980 |
| JP | H03-283454 | A | 12/1991 |
| JP | H06347182 | A | 12/1994 |
| JP | H09-133482 | A | 5/1997 |
| JP | H09133482 | A | 5/1997 |
| JP | H09167818 | A | 6/1997 |
| JP | H09-264677 | A | 10/1997 |
| JP | H11-294981 | A | 10/1999 |
| JP | 2001227886 | A | 8/2001 |
| JP | 2002151636 | A | 4/2002 |
| JP | 2007-192474 | A | 8/2007 |
| JP | 2010133686 | A | 6/2010 |
| JP | 2013-098568 | A | 5/2013 |
| SU | 861917 | A1 | 9/1981 |
| WO | WO 2009106573 | A1 | 9/2009 |
| WO | WO 2010072221 | A2 | 7/2010 |

OTHER PUBLICATIONS

English translation of Denso Corp. JP H09-264677 1997.*

Invitation to Pay Additional Fees dated Dec. 8, 2015 in corresponding International Patent Application No. PCT/US2015/048162.

International Search Report and Written Opinion dated Apr. 14, 2016 for corresponding International Patent Application No. PCT/US2015/049358.

Invitation to Pay Additional Fees dated Dec. 8, 2015 in corresponding International Patent Application No. PCT/US2015/049358.

International Preliminary Report on Patentability for International Application No. PCT/US2015/049358, dated Mar. 30, 2017.

* cited by examiner

THERMOSIPHON WITH BENT TUBE SECTION

CROSS REFERENCE TO RELATED APPLICATION

This application claims the benefit of U.S. Provisional Application No. 62/050,463, filed Sep. 15, 2014, which is hereby incorporated by reference in its entirety.

BACKGROUND OF THE INVENTION

1) Field of Invention

This invention relates generally to thermosiphon devices and other heat transfer devices that employ a two-phase fluid for cooling.

2) Description of Related Art

Thermosiphon devices are widely used for cooling systems, such as integrated circuits and other computer circuitry. For example, U.S. Patent Publication 2013/0104592 discloses a thermosiphon cooler used to cool electronic components located in a cabinet or other enclosure.

SUMMARY OF THE INVENTION

In one aspect of the invention, a thermosiphon device may include one or more multi-port tubes that form both an evaporator section and a condenser section for the device. The one or more tubes, which may be arranged as flat tubes with multiple, parallel flow channels, may be bent to form a bend between the evaporator and condenser sections of the tube. One or more flow channels of the tube at the bend may provide a vapor flow path or a liquid flow path between the evaporator and condenser sections. Such an arrangement may provide for a more efficient and economically made thermosiphon device, e.g., in contrast to devices in which the liquid return path (which conducts condensed cooling liquid from a condenser section to an evaporator section) and/or a vapor supply path (which conducts evaporated liquid from the evaporator section to the condenser section) are arranged as physically independent parts in relation to the evaporation and condensing channels. For example, such devices are arranged with dedicated liquid return and vapor supply conduits to route liquid/vapor to desired sections of the thermosiphon device. This approach is taken, at least in some cases, in an effort to ensure that cyclical flow in the device is not disrupted, e.g., by liquid in the liquid return conduit prematurely evaporating or vapor in the vapor supply conduit prematurely condensing. As is understood by those of skill in the art, such premature evaporation/condensation can disrupt the cyclical flow in a thermosiphon device, which occurs by gravity alone, and without the use of pumps or other fluid movers. However, aspects of the invention enable the successful integration of a liquid return path and/or vapor supply path with one or more tubes that provide evaporator and condenser sections without disruption of flow in a thermosiphon device.

For example, in some embodiments, one or more flat, multi-channel tubes may be bent to form a bend that extends along an arc of 45 degrees, 90 degrees, 180 degrees or more. Portions of the tubes on opposite sides of the bend may provide evaporator and condenser sections, respectively, of the thermosiphon device, and at least one channel of the tubes at the bend may provide a vapor or liquid flow path between the evaporator and condenser sections. In some arrangements ends of the tubes may be attached to a single header or manifold, e.g., to provide a vapor or liquid flow path between the evaporator and condenser sections.

These and other aspects of the invention will be apparent from the following description.

BRIEF DESCRIPTION OF THE DRAWINGS

The accompanying drawings, which are incorporated in and form a part of the specification, illustrate select embodiments of the present invention and, together with the description, serve to explain the principles of the inventions. In the drawings.

DETAILED DESCRIPTION

Figure 1:
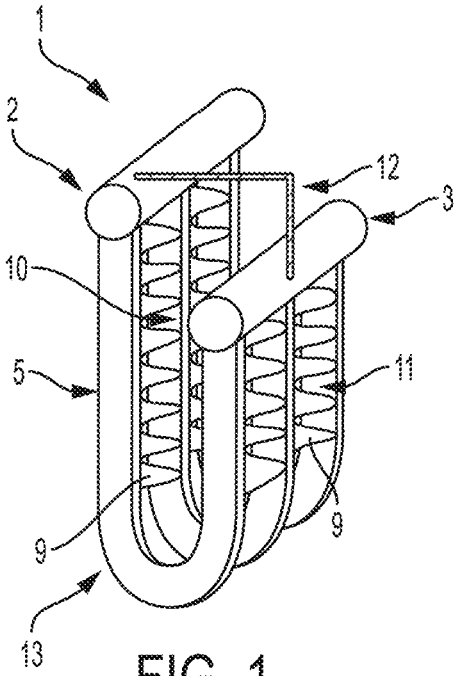
FIG. 1 is a perspective view of a thermosiphon device in an illustrative embodiment that incorporates aspects of the invention.

Aspects of the invention are not limited in application to the details of construction and the arrangement of components set forth in the following description or illustrated in the drawings. Other embodiments may be employed and aspects of the invention may be practiced or be carried out in various ways. Also, aspects of the invention may be used alone or in any suitable combination with each other. Thus, the phraseology and terminology used herein is for the purpose of description and should not be regarded as limiting.

Figure 1A:
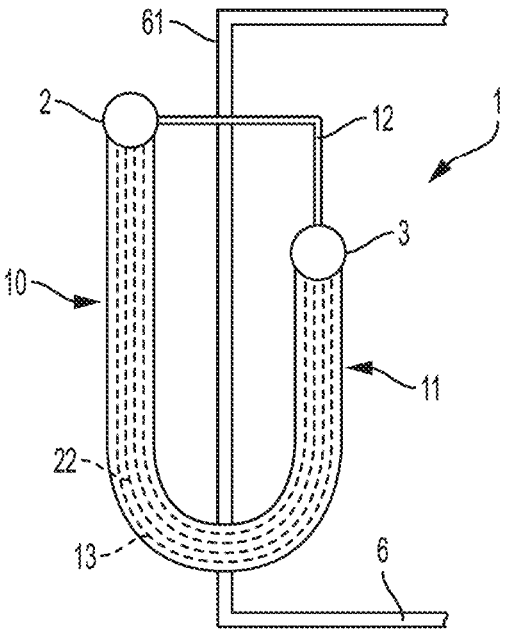
FIG. 1*a* shows a side view of the FIG. 1 embodiment with a portion of an associated enclosure.

FIGS. 1 and 1*a* show an illustrative embodiment of a thermosiphon device 1 that incorporates aspects of the invention, e.g., that includes a bent tube section that functions as a liquid return path and/or a vapor supply path. As can be seen in FIG. 1*a*, this embodiment is arranged to operate with an enclosure 6 which may house electronic devices or other heat-generating components. An evaporator section 11 of the thermosiphon device 1 may be positioned inside of the enclosure 6, i.e., on a right side of a panel 61 of the enclosure 6 in FIG. 1*a*, and a condenser section 10 may be positioned outside of the enclosure 6, i.e., on a left side of the panel 61. In some embodiments, the panel 61 may be an access door to the enclosure 6, and the thermosiphon device 1 may be mounted to the door. Such an arrangement may allow for relatively easy access to the device 1, e.g., for replacement, service, etc. In this embodiment, the device 1 may include one or more evaporator sections 11 positioned in the sealed enclosure 6, and one or more condenser sections 10 may be positioned outside of the sealed enclosure 6. As is known to those in the art, heat may be received by the device 1 at the evaporator section(s) 11, e.g., by evaporating a working fluid, and dissipated at the condenser section(s) 10, e.g., by condensing the evaporated fluid to a liquid. The panel 61 may define a dividing point between portions inside of the enclosure 6 and an environment outside of the enclosure. By providing the evaporator section(s) 11 inside the sealed enclosure 6 and the condenser section(s) 10 outside of the enclosure 6, devices in the enclosure 6 may be cooled while being contained in an environment protected from external conditions, e.g., protected from dirt, dust, contaminants, moisture, etc. Of course, use of a thermosiphon device 1 with a sealed enclosure is not required, e.g., the device may be used in a completely open system in which heat generating devices to be cooled are thermally coupled to one or more evaporator section(s) 11 of the device 1.

In accordance with an aspect of the invention, the thermosiphon device 1 includes at least one multi-port tube 5 with a bend 13 between condenser and evaporator sections 10, 11 that provides a liquid flow path to conduct condensed liquid from the condenser section 10 to the evaporator section 11. That is, working fluid is evaporated in the evaporator section(s) 11 and flows upwardly due to gravity to a second manifold 3 that is connected to the end of the evaporator section 11 of the tube opposite the bend 13. Vapor flows through a conduit 12 to a first manifold 2 and into one of a plurality of channels 22 in the condenser section 10 of the tube(s). Condensed vapor flows downwardly in the channels 22 toward the bend 13 and returns to the evaporator section 11. Thus, the bend provides a liquid flow path to return condensed liquid to the evaporator section 10. As discussed below, the bend 13 may provide a vapor flow path to conduct fluid evaporated in the evaporator section to the condenser section, rather than providing a liquid flow path. By providing one or more multi-port tubes 5 with a bend to function as a liquid or vapor flow path between condenser and evaporator sections 10, 11 of the tube 5, manufacture and assembly of the device 1 can be greatly simplified. For example, the device 1 may be assembled without the bend 13 being formed, e.g., the manifolds 2, 3 may be attached to ends of the tube(s) 5, fins 9 or other thermal transfer structure may be secured to portions of the tube(s), etc., and thereafter the bend 13 may be formed. (The conduit 12 may be secured after bending is complete.)

As will be understood, the fins 9 or other thermal transfer structure (e.g., pins, channels, cold plates, etc.) are attached to the condenser and evaporator sections 10, 11 of the tube(s), e.g., so heat is received into the device 1 at the evaporator section 10 by means of the fins 9 and heat flows out of the system by means of the fins 9. No fins or other thermal transfer structure 9 are attached to the bend 13 in this embodiment, thereby allowing the tube(s) to be bent at a relatively small bend radius. That is, the multi-port tube 5 may be generally flat and may be bent about an axis that is perpendicular to a plane of the flat tube 5 to form the bend 13. In addition, the tube 5 may be twisted about an axis that extends along a length of the flat tube 5, e.g., to allow for an even smaller bend radius at the bend 13.

Figure 2:
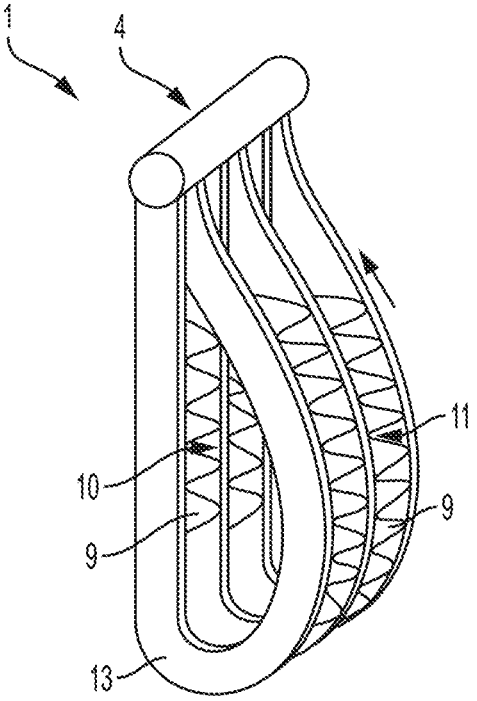
FIG. 2 shows a cross sectional view of a thermosiphon device including a single manifold in an illustrative embodiment.
Figure 2A:
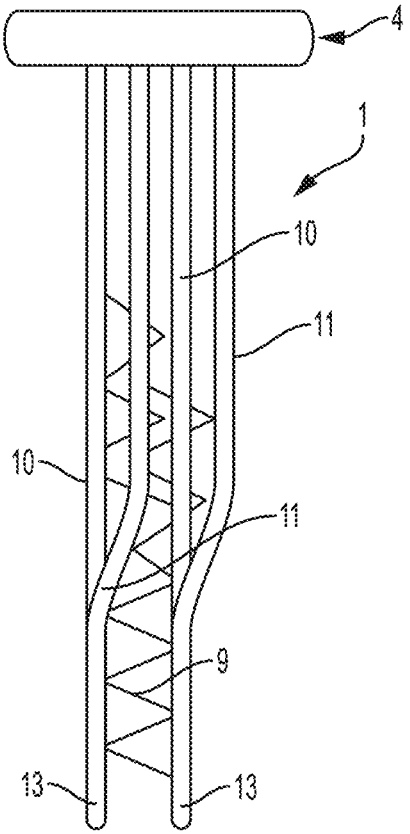
FIG. 2*a* shows a front view of the FIG. 2 embodiment.

In accordance with another aspect of the invention, a thermosiphon device including at least one multi-port tube 5 with a bend 13 between condenser and evaporator sections 10, 11 may have ends of the tube 5 opposite the bend 13 attached to a single manifold. For example, FIGS. 2 and 2*a* show a device 1 having one or more multi-port tubes 5 with both ends attached to a single manifold 4. The device 1 may be employed in a manner like that shown in FIG. 1*a*, e.g., may be mounted to a door or other panel 61 of an enclosure 6 so that the manifold 4 and condenser section(s) 10 are located outside of the enclosure 6 and the evaporator section(s) 11 are inside of the enclosure 6. As will be understood, the manifold 4 provides a fluid connection between the ends of the tubes 5 so that vapor flowing upwardly in the evaporator section(s) 11 enters the manifold 4 and then flows downwardly into the condenser section(s) 10. In this embodiment, the ends of the tubes 5 are attached to the manifold 4 along a single line on the manifold 4. For example, and as can be seen in FIG. 2*a*, the ends of the tubes 5 may alternate such that ends of the tubes 5 adjacent the evaporator sections 11 alternate with ends of the tubes 5 adjacent the condenser sections 10. The tubes may be bent or otherwise formed to have an offset as can be seen in FIG. 2*a* to allow the tube ends to be interdigitated and attached to the manifold 4 along a single line, e.g., so a line extending along a length of the manifold 4 passes through the ends of the tubes 5 where the tubes attach to the manifold 4. Of course, other arrangements are possible, e.g., each of the tubes 5 may be arranged in a single plane with no offset and be attached to the manifold 4 so that the tube ends lie in a plane that is parallel to the plane of the flat tube. While the FIG. 1 embodiment shows the tubes having a bend 13 that extends along about a 180 degree arc, other extensions of the bend 13 are possible, such as that shown in FIG. 2 in which the bends 13 extend along an arc of more than 180 degrees. It will also be appreciated that bend arcs less than 180 degrees, such as 45 degrees or more (or less), are possible.

Figure 3:
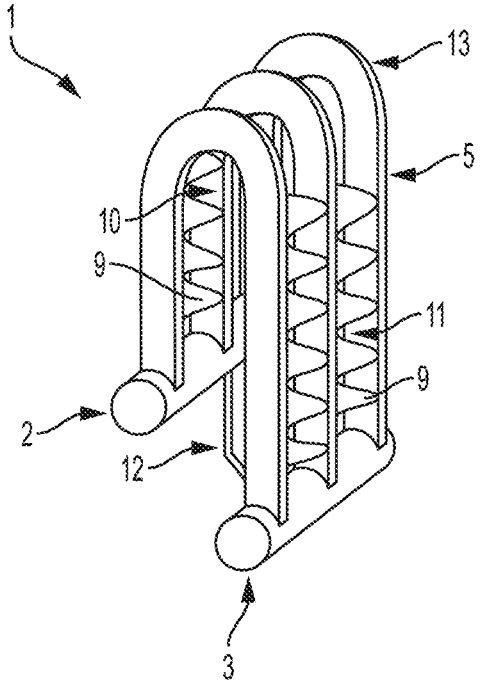
FIG. 3 shows a perspective view of an embodiment like that in FIG. 1 in inverted form.

While in the FIGS. 1 and 2 embodiments, the bend 13 of the tubes 5 provides a liquid flow path to return condensed liquid from the condenser section 10 to the evaporator section 11, the bend 13 of the tube(s) 5 may provide a vapor flow path between the evaporator and condenser sections 10, 11. For example, FIG. 3 shows an arrangement similar to that in FIGS. 1 and 1*a*, but is inverted so that the first and second manifolds 2, 3 are positioned below the bends 13. That is, in FIGS. 1 and 1*a*, the first and second manifolds 2, 3 are positioned above the bend 13, and the first manifold 2 is positioned above the second manifold 3 to encourage proper vapor flow from the second manifold 3 to the first manifold 2. However, in the FIG. 3 embodiment, the bend 13 is positioned above the manifolds, 2, 3, and the first manifold 2 is positioned above the second manifold 3 to encourage proper condensed liquid flow from the first manifold 2 to the second manifold 3. Vapor in the condenser section(s) 10 condenses with the removal of heat, and condensed liquid flows downwardly in channels of the tubes 5 into the first manifold 2. Liquid then flows to the second manifold 3 via the conduit 12 and into channels of the tubes 5 in the evaporator sections 11. Fins 9 and/or other thermal transfer structure aid in heat transfer in desired portions of the tubes 5, e.g., at the condenser and evaporator sections 10, 11, and evaporated working fluid flows upwardly from the evaporator section(s) 11 through the bend(s) 13 and into the condenser section(s) 10. As with the FIGS. 1 and 1*a* embodiment, the FIG. 3 embodiment may be associated with an enclosure 6, e.g., so that a panel 61 is positioned between the evaporator and condenser sections 10, 11, and the bends 13 and the conduit 12 pass through the panel 61.

Figure 3A:
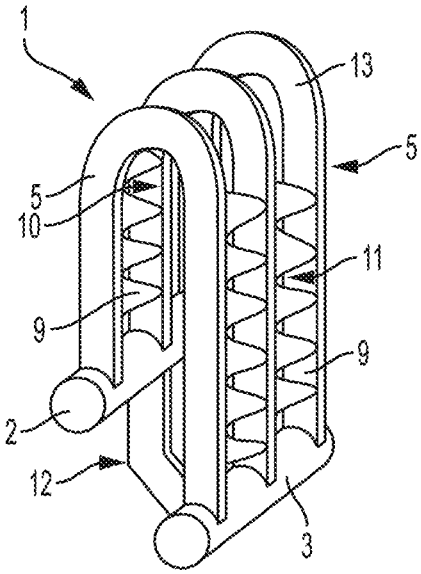
FIG. 3*a* shows a modified version of the FIG. 3 embodiment including a multi-port tube segment fluidly connecting manifolds of the device.

FIG. 3*a* shows an alternate arrangement for the FIG. 3 embodiment in which a single flow channel pipe for the conduit 12 is replaced with one or more multi-port tubes. The multi-port tube used for the conduit 12 may be arranged as a flat tube, or in other ways, and one or more conduits 12 extending between the first and second manifolds 2, 3 may be provided.

Figure 4:
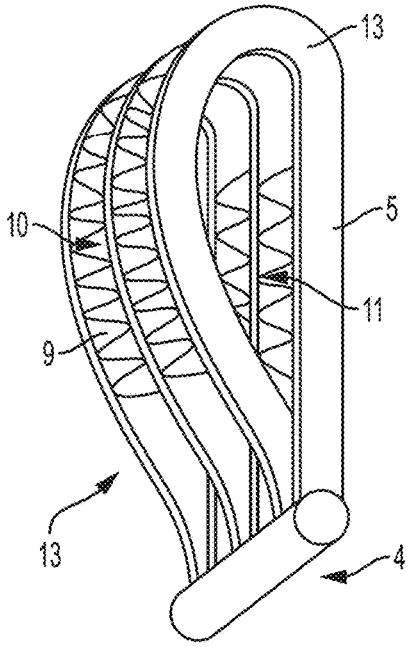
FIG. 4 shows a perspective view of an embodiment like that in FIG. 2 in inverted form.
Figure 4A:
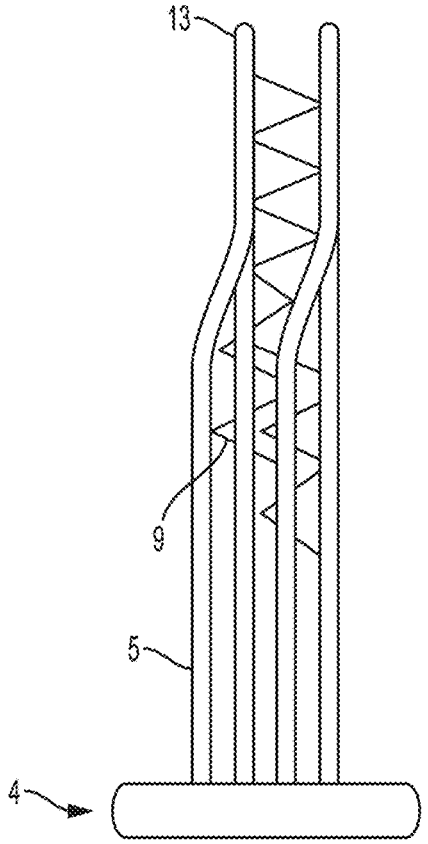
FIG. 4*a* shows a front view of the FIG. 4 embodiment.

FIGS. 4 and 4*a* show an alternate arrangement that is configured like that in FIGS. 2 and 2*a*, but is inverted so the manifold 4 is positioned below the bend(s) 13. Thus, the bends 13 in this embodiment provide a vapor flow path between the evaporator and condenser sections 10, 11. Otherwise, the embodiment of FIGS. 4 and 4*a* is identical in structure to the FIGS. 2 and 2*a* embodiment.

Figure 5:
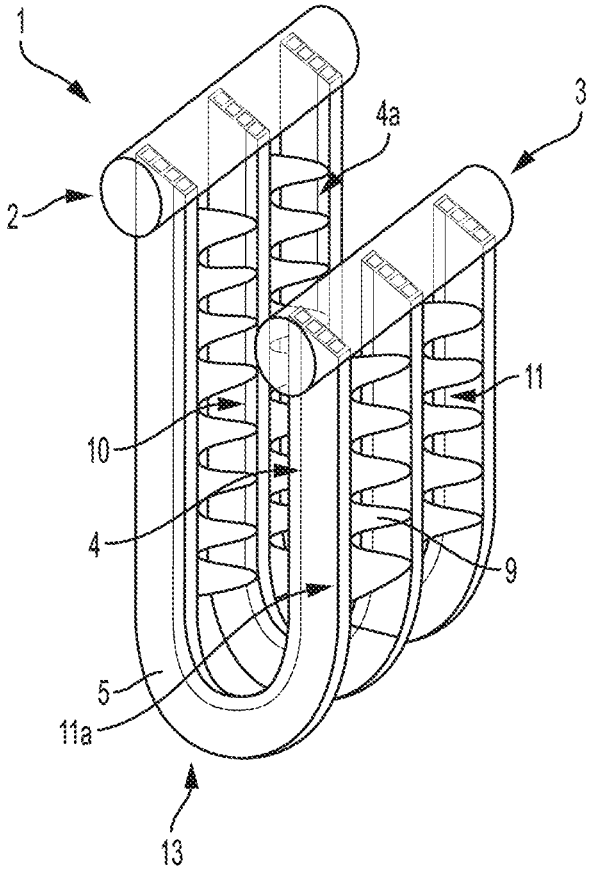
FIG. 5 shows a perspective view of an embodiment of a thermosiphon device in which a bend in a multi-port tube provides vapor and liquid flow paths between evaporator and condenser sections.

In another aspect of the invention, a thermosiphon device 1 may include a bent tube section that functions as a liquid return path and a vapor supply path for evaporator and condenser sections of the tube. For example, FIG. 5 shows an illustrative embodiment in which one or more channels at a bend of a multi-port tube provide a liquid flow path and one or more channels at the bend provide a vapor flow path between evaporator and condenser sections of the tube. In this embodiment, the thermosiphon device 1 includes multiple multi-port tubes 5 that have ends respectively attached to first and second manifolds 2, 3. Ends of the tubes 5 adjacent a condenser section 10 are attached to the first manifold 2, and ends of the tubes 5 adjacent an evaporator section 11 are attached to the second manifold 3, e.g., in way similar to that of the FIG. 1 embodiment. Thus, condensed liquid in the condenser sections 10 flows downwardly in one or more channels 22 of the condenser section 10 into the bend 13 and to the evaporator section 11. However, in contrast to the FIG. 1 embodiment, one or more of the channels 22 of the tubes 5, specifically a vapor supply path 4 at an inner side of the tubes 5, conducts vapor from the second manifold 3 to the first manifold 2. Vapor conducted to the first manifold 2 flows downwardly into the condenser section 10 to be condensed to liquid and repeat the cooling cycle. Note that in this embodiment, the fins 9 or other thermal transfer structure that provides heat to the evaporator section 11 are not attached to portions of the tubes 5 near an upper part of the vapor supply path 4, but are attached to portions of the tubes 5 near a lower part of the vapor supply path 11 at an overheat area 11*a* of the evaporator section 11. In this way, vapor in the vapor supply path 4 is overheated in the overheat area 11*a* prior to entering the portion of the vapor supply path in the condenser section 10, i.e., vapor supply path portion 4*a*. Since vapor in the vapor supply path portion 4*a* will lose heat, overheating the vapor at the overheat area 11*a* assists in maintaining proper vapor flow in the vapor supply path 4, e.g., the overheat area 11*a* may be designed such that the vapor overheat is large enough to eliminate liquid condensing in the vapor supply path portion 4*a*. (Failure to overheat vapor in the overheat area 11*a* will cause vapor to condense in vapor supply path portion 4*a* and the condensed liquid will flow to the bottom of the vapor supply path 4, blocking vapor flow and limiting or possibly stopping the loop operation of the device 1.) Fins 9 or other thermal transfer structure may not be attached to the tubes 5 at portion of the vapor supply path portion 4*a*, e.g., to reduce heat transfer. In some embodiments, the vapor supply path portion 4*a* may be insulated to assist in maintaining proper vapor flow without condensation in the vapor supply path portion 4*a*.

In accordance with another aspect of the invention, a thermosiphon device may include an evaporator section including a plurality of evaporator channels extending downwardly from an upper evaporator header, a condenser section including a plurality of condenser channels extending upwardly from a lower condenser header, and a conduit connecting the lower condenser header and the upper evaporator header, where the conduit includes a vapor supply channel and a liquid return channel. The vapor supply channel and the liquid return channel may be separate from each other in the conduit, and in some embodiments, may communicate with respective vapor chambers and liquid chambers in the lower condenser header and the upper evaporator header. For example, the condenser header and the evaporator header may each include a separation wall that separates vapor and liquid chambers in the header, and the vapor supply channel and the liquid return channel may communicate with the respective vapor and liquid chambers in the headers.

Figure 6:
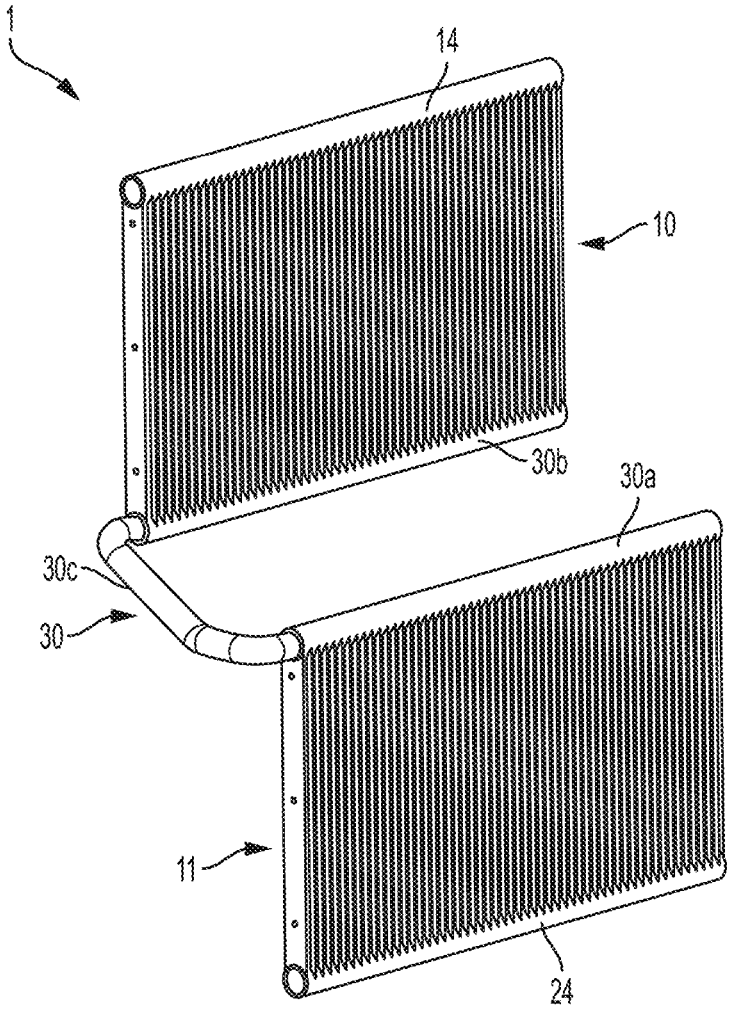
FIG. 6 shows a perspective view of an embodiment of a thermosiphon device having a evaporator and condenser sections connected by a conduit having vapor and liquid flow channels.

For example, FIG. 6 shows a perspective view of a thermosiphon device 1 including an evaporator section 11 with upper and lower headers 30*a*, 24, and the condenser section 10 with upper and lower headers 14, 30*b*. (The upper condenser header 14 and/or lower evaporator header 24 are not required and may be omitted.) A conduit 30*c* fluidly couples the lower condenser header 30*b* and the upper evaporator header 30*a* so that vapor may travel from the upper evaporator header 30*a* to the lower condenser header 30*b* and so that liquid may travel from the lower condenser header 30*b* and the upper evaporator header 30*a*. In this embodiment, the conduit 30*c* includes separate vapor supply and liquid return channels, and these vapor supply and liquid return channels may fluidly communicate, respectively, with vapor and liquid chambers in the headers 30*a*, 30*b*. Thus, the headers 30*a*, 30*b* and the conduit 30*c* may together form a manifold 30 that provides dedicated liquid and vapor flow paths between the condenser and evaporator sections 10, 11. In some embodiments, the FIG. 6 embodiment may be arranged to operate with an enclosure 6 similar to that described with reference to FIG. 1, e.g., the evaporator section 11 may be positioned inside of a sealed enclosure 6, the condenser section 10 may be positioned outside of the enclosure 6, and the conduit 30*c* may pass through a panel 61 of the enclosure 6. This arrangement may require only a single opening in the panel to provide both vapor and liquid flow paths for the thermosiphon device 1.

Figure 7:
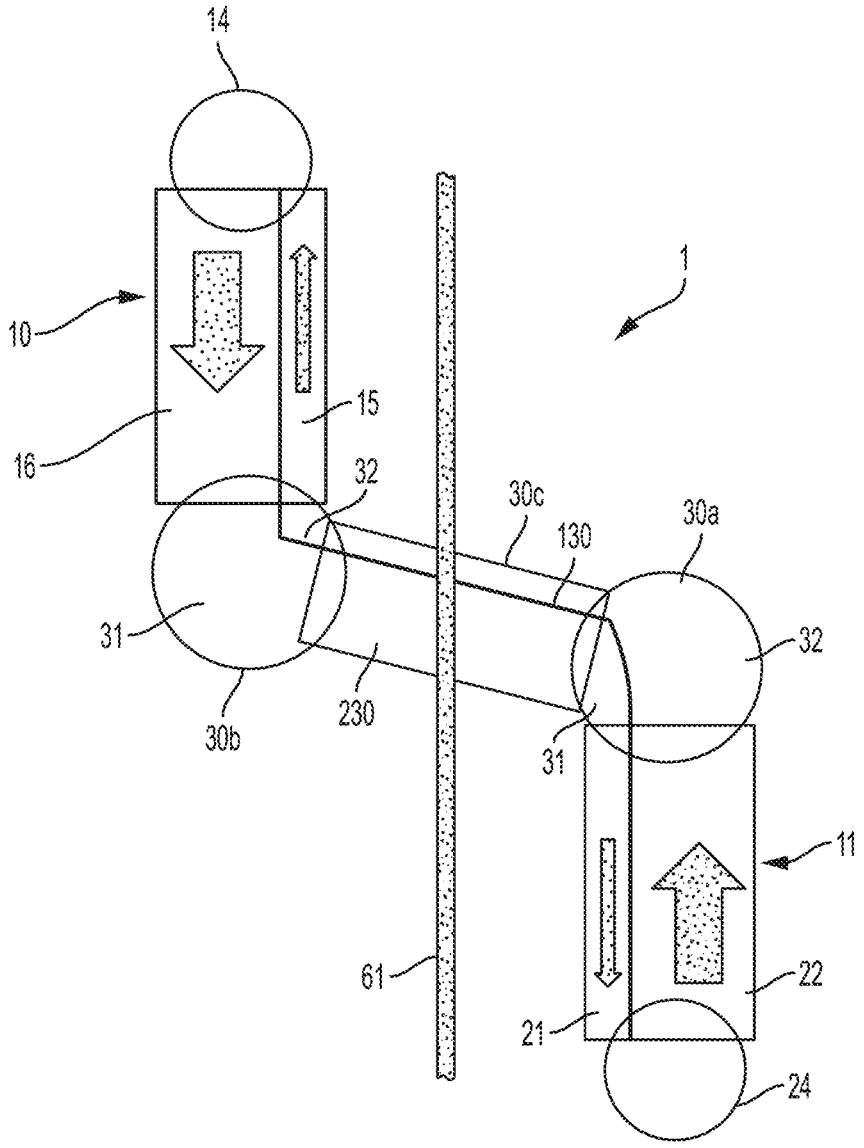
FIG. 7 shows a schematic side view of the FIG. 6 embodiment and associated enclosure.

FIG. 7 shows a schematic side view of the FIG. 6 embodiment, and includes an illustrative panel 61 of an enclosure 6. As can be seen, the lower condenser header 30 and the upper evaporator header 30*a* include a vapor chamber 32 and a liquid chamber 31. The vapor chambers 32 are in fluid communication with a vapor supply channel 130 of the conduit 30*c*, and the liquid chambers 31 are in fluid communication with the liquid return channel 230 of the conduit 30*c*. The vapor chamber 32 of the lower condenser header 30*b* is in fluid communication with a vapor supply path 15, which provides vapor to the upper condenser header 14, and the liquid chamber 31 is in fluid communication with one or more condensing channels 16 of the condenser section 10. The vapor chamber 32 of the upper evaporator header 30*a* is in fluid communication with one or more evaporation channels 22 of the evaporator section 11 and the liquid chamber 31 is in fluid communication with a liquid return path 21 which provides condensed fluid to the lower evaporator header 24.

Figure 8:
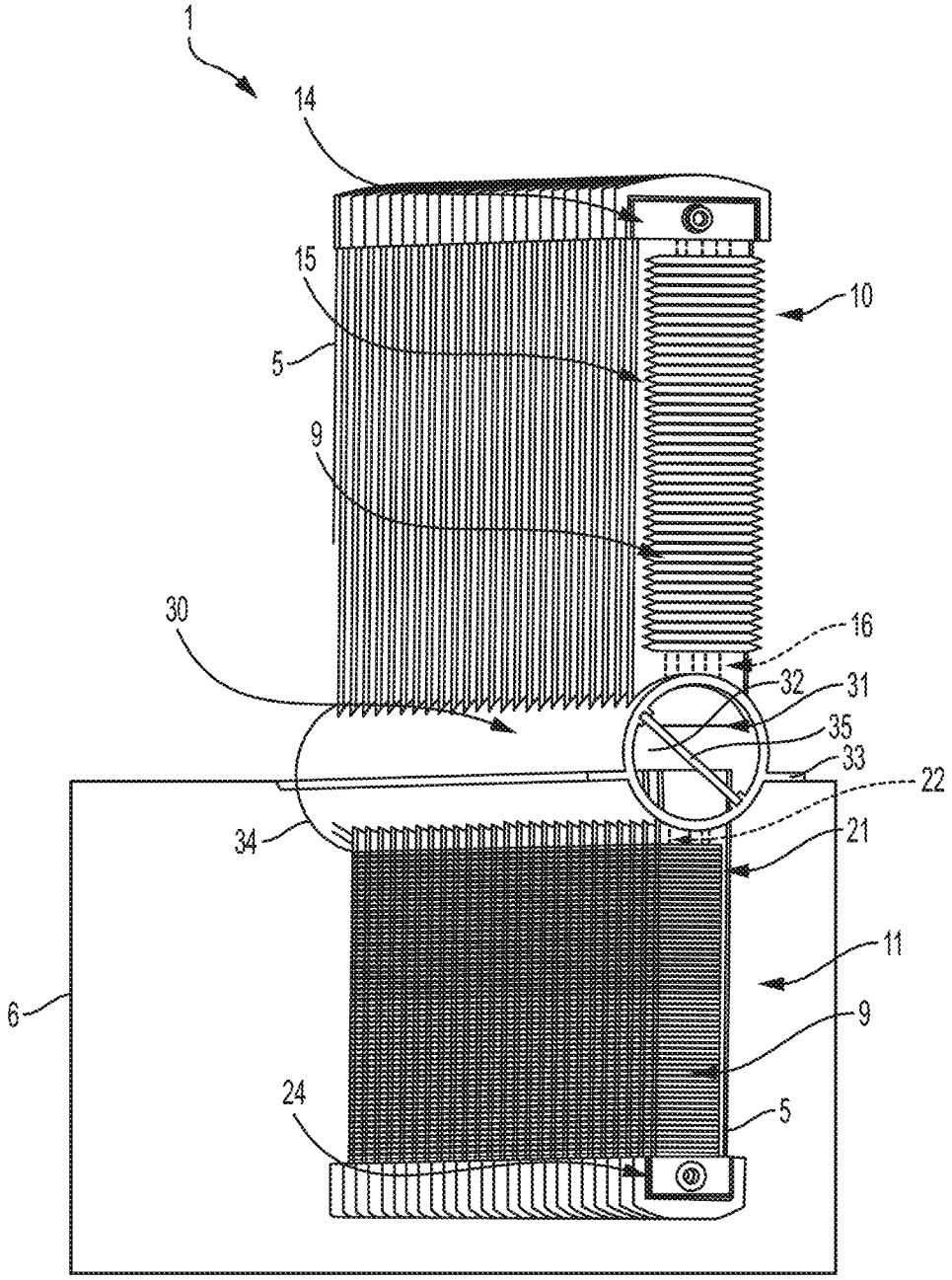
FIG. 8 shows an illustrative embodiment of a thermosiphon device having a manifold with vapor and liquid chambers connecting evaporator and condenser sections.

FIG. 8 shows a schematic perspective view of a thermosiphon device 1 that includes a manifold 30 that includes vapor and liquid chambers 32, 31, and engages with evaporator and condenser sections 11, 10 in an illustrative embodiment. Although this embodiment does not includes a conduit 30*c*, the manifold 30 in FIG. 8 illustrates how the lower condenser header 30*b* and the upper evaporator header 30*a* may engage with condenser and evaporator sections 10, 11, respectively, while providing separate vapor and liquid chambers 32, 31 in the header 30*a*, 30*b*. In this embodiment, the condenser and evaporator sections 10, 11 include multi-port tubes 5 that each include multiple channels. In the condenser section 10, some of the channels in each tube 5 may function as condensing channels 16, while one or more channels may function as a vapor supply path 15. Thermal transfer structure 9 (e.g., fins) may be engaged with portions of the tubes 5 adjacent the condensing channels 16, while portions of the tubes 5 adjacent the vapor supply path 15 may be free of thermal transfer structure 9. In the evaporator section 11, some of the channels in each tube 5 may function as evaporation channels 22, while one or more channels may function as a liquid return path 21. Thermal transfer structure 9 (e.g., fins) may be engaged with portions of the tubes 5 adjacent the evaporation channels 22, while portions of the tubes 5 adjacent the liquid return path 21 may be free of thermal transfer structure 9.

Figure 9:
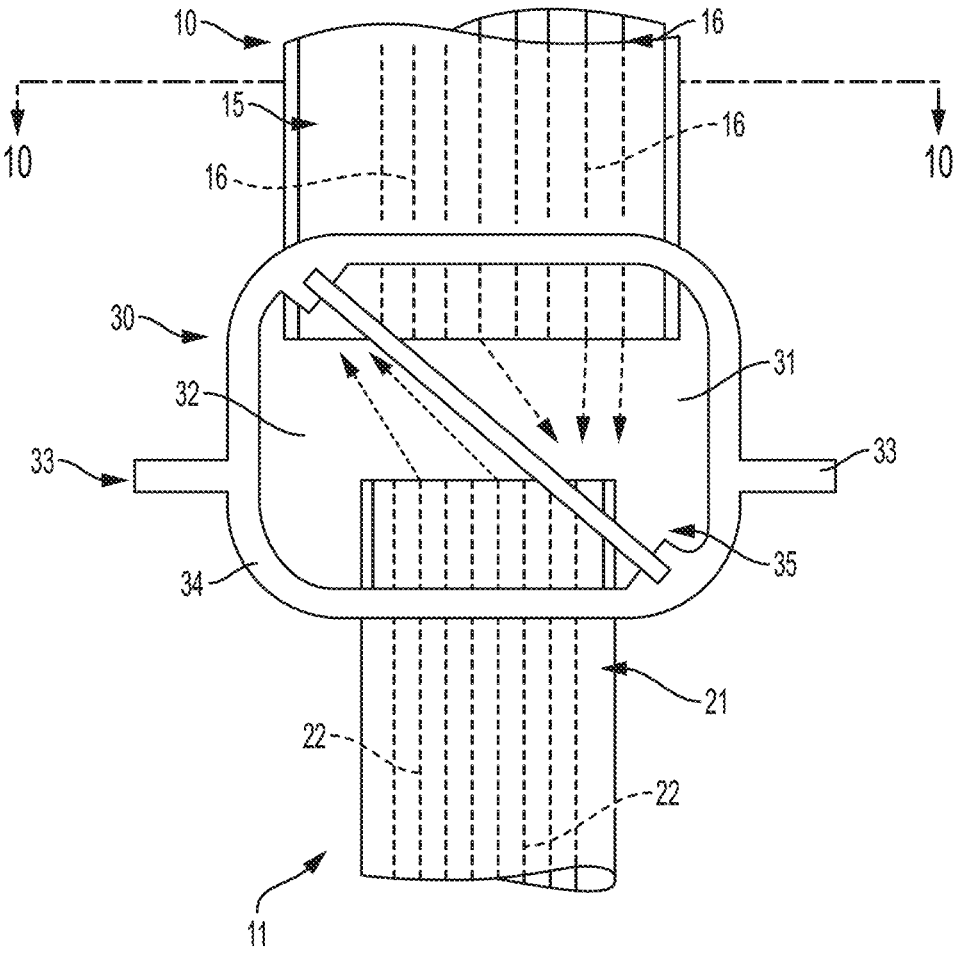
FIG. 9 shows a close up view of a manifold for use in the FIG. 8 embodiment.

In simplified form and as can be seen in FIG. 9, the thermosiphon device 1 operates to cool heat generating devices by receiving heat at the evaporator section(s) 11 such that liquid in evaporation channels 22 boils or otherwise vaporizes. Heat may be received at the evaporation channels 22 by warm air (heated by the heat generating devices) flowing across a thermal transfer structure 9 that is thermally coupled to the evaporation channels 22 or in other ways, such as by a direct conductive path, one or more heat pipes, a liquid heat exchanger, etc. Vapor flows upwardly from the evaporation channels 22 into a vapor chamber 32 of a manifold 30, and then into a vapor supply path 15 of a condenser section 10. The vapor continues to flow upwardly in the vapor supply path 15 until reaching the header 14 of the condenser section 10. At this point, the vapor flows downwardly into one or more condensing channels 16 of the condenser section 10, where the vapor condenses to a liquid and flows downwardly into a liquid chamber 31 of the manifold 30. Heat removed from the vapor during condensation may be transferred to thermal transfer structure 9 coupled to the condensing channels 16, e.g., one or more fins conductively coupled to the condenser section 10 adjacent the condensing channels 16. In turn, heat may be removed from the thermal transfer structure 9 by cool air flowing across the structure 9, by a liquid bath, a liquid heat exchanger, refrigerant coils, or other arrangement. The condensed liquid flows downwardly from the condensing channels 16 into the liquid chamber 31 and then into a liquid return path 21 of an evaporator section 11 until reaching the header 24 of the evaporator section 11. The liquid then enters an evaporator channel 22 and the process is repeated.

Figure 10:
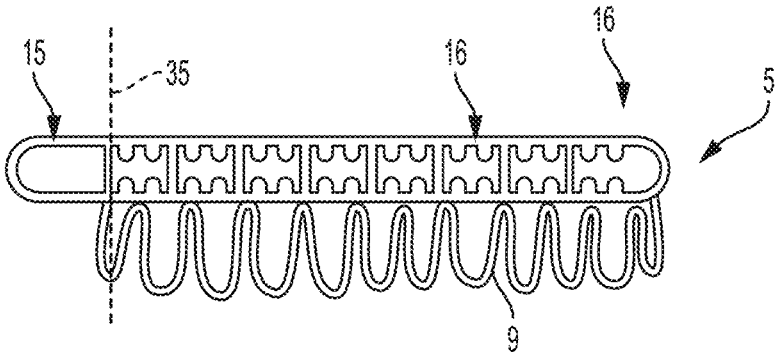
FIG. 10 shows a cross sectional view along the line 10-10 in FIG. 9.

In accordance with another aspect of the invention, a single manifold may be used to fluidly couple both evaporator channels of an evaporator with a vapor supply path of a condenser section, and condensing channels of a condenser with a liquid return path of an evaporator section. For example, in the FIG. 9 embodiment, the manifold 30 includes an outer wall 34 that defines an internal space. In this embodiment, the outer wall 34 has a square tube or cylindrical shape, but any other suitable shape is possible. A separation wall 35 is arranged in the manifold 30 to separate the internal space into the liquid chamber 31 and the vapor chamber 32. This arrangement provides a simple and effective way to fluidly couple portions of the thermosiphon device 1. Also, the separation wall 35 may engage with condenser and evaporator sections 10, 11 so as to fluidly couple condenser channels 16 and the liquid return path 21 with the liquid chamber 31 and fluidly couple evaporator channels 22 and the vapor supply path 15 with the vapor chamber 32. As a result, assembly can be simplified and the number of parts and/or assembly steps to make needed fluid connections can be minimized. For example, a separation wall 35 (e.g., a wall 35 in the lower condenser header 30*b*) may be engaged with multi-port tubes 5 so as to put condensing channels 16 and the vapor supply path 11 on opposite sides of the separation wall 35, or a separation wall 35 (e.g., a wall 35 in the upper evaporator header 30*a*) may be engaged with multi-port tubes 5 so as to put evaporator channels 22 and the liquid return path 21 on opposite sides of the separation wall 35. In this illustrative embodiment and as can be seen in FIG. 10, the condenser and evaporator sections 10, 11 include flat tubes 5 having multiple parallel channels, and a manifold end of each tube 5 may be inserted into the internal space of the manifold 30, e.g., through an opening in the outer wall 34. The separation wall 35 may include slots or other openings to receive a part of the manifold end of the tubes 5 thereby providing desired communication of the different portions of the condenser and evaporator sections 10, 11 with the vapor and liquid chambers 32, 31. For example, the separation wall 35 (e.g., a wall 35 in the upper evaporator header 30*a*) may include a liquid chamber slot or opening that receives a portion of the evaporator section 11 (on the right in FIG. 9) that defines the liquid return path 21. However, parts of the evaporator section 11 (on the left in FIG. 9) that define the evaporation channels 22 are not received in the liquid chamber slot or opening of the separation wall 35. As a result, the liquid return path 21 is put in communication with the liquid chamber 31 and the evaporation channels 22 are put in communication with the vapor chamber 32. Similarly, the separation wall 35 (e.g., a wall 35 in the lower condenser header 30*b*) may include a vapor chamber slot or opening to receive a portion of the condenser section 10 (on the left in FIG. 9) that defines the vapor supply path 15, but not portions that define the condenser channels 16 (on the right in FIG. 9). Thus, the vapor supply path 15 is put in fluid communication with the vapor chamber 32 and the condensing channels 16 are put in fluid communication with the liquid chamber 31. Although in this embodiment, the separation wall 35 is formed as a flat plate that is received into corresponding grooves formed in the inner side of the outer wall 34, other arrangements are possible. For example, the separation wall 35 need not be flat, but may be curved or otherwise shaped in any suitable way. If used, grooves in the inner side of the outer wall 34 may be formed by scoring, broaching, casting, extruding or other techniques. Also, the conduit 30*c* may be formed in a way like that shown in FIG. 9, e.g., with an outer wall 34 and separation wall 35 to separate vapor supply and liquid return channels.

Figure 11:
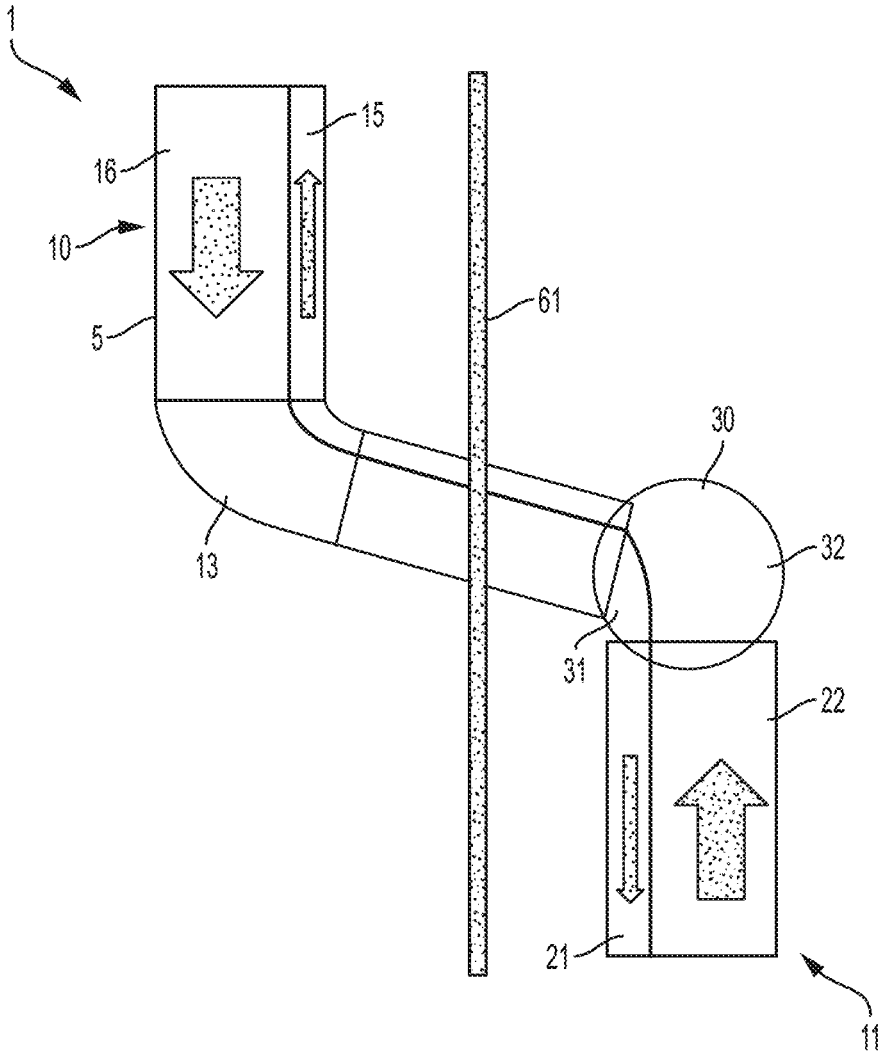
FIG. 11 shows a schematic side view of an altered version of the thermosiphon device of FIG. 6.

FIG. 11 shows an altered version of the FIG. 6 embodiment in which the lower condenser header 30*b* is eliminated. Instead, multi-port condenser tubes 5 are bent to have a bend 13 and engage at an end with the upper evaporator header

30*a*. The condenser tubes 5 may engage with the upper evaporator header 30*a* in a way similar to that in FIG. 9, e.g., so the vapor supply path 15 is in communication with the vapor chamber 32 and the condenser channels 16 are in communication with the liquid chamber 31. Also in this embodiment, the tubes 5 may extend through openings in a panel 61 of an enclosure 6, if desired. In another arrangement, the upper evaporator header 30*a* may be engaged with the panel 61, e.g., so that a flange 33 of the outer wall 34 engages with the panel 61 at an opening and part of the header 30*a* is positioned outside of the enclosure 6.

Figure 12:
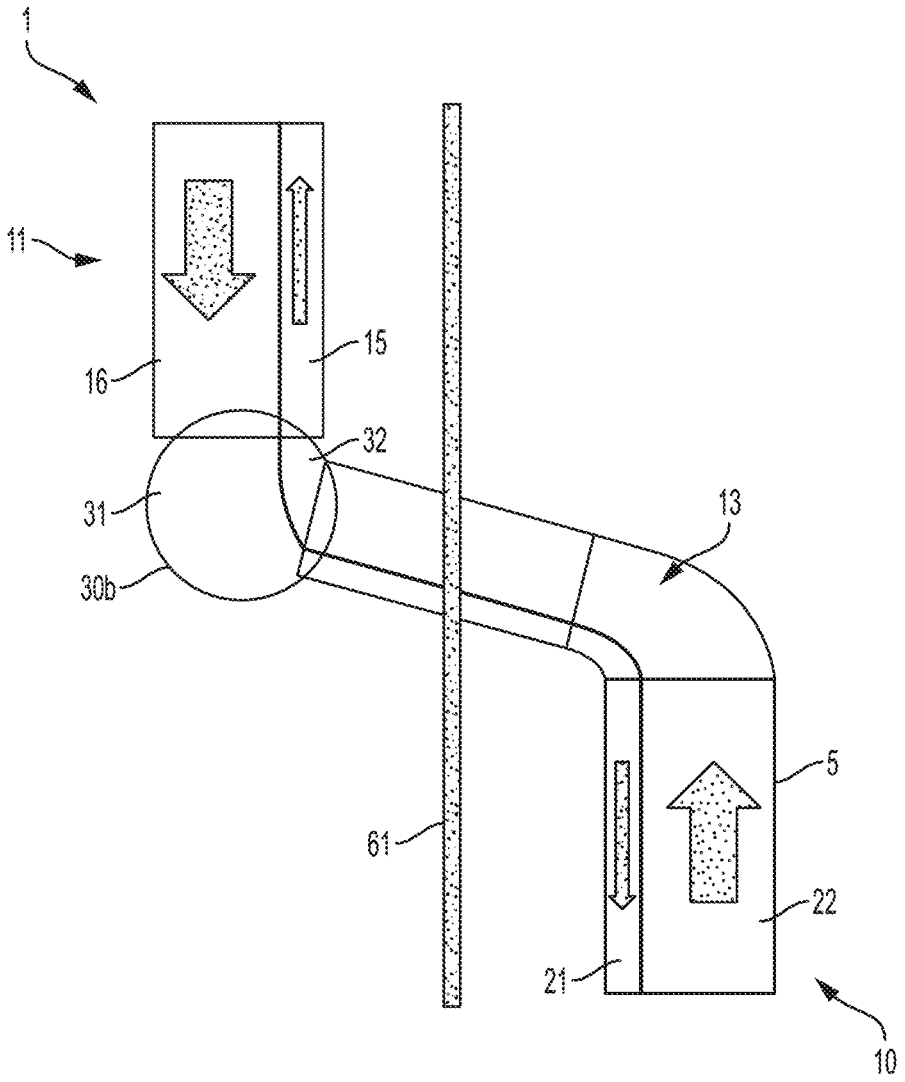
FIG. 12 shows a schematic side view of another altered version of the thermosiphon device of FIG. 6.

FIG. 12 shows another altered version of the FIG. 6 embodiment, but in which the upper evaporator header 30*a* is eliminated. Instead, multi-port tubes 5 of the evaporation section 10 are bent to have a bend 13 and engage with the lower condenser header 30*b*, e.g., in a way like that shown in FIG. 9. As in the FIG. 11 embodiment, the tubes 5 may extend through a panel 61 of an enclosure, and/or the lower header 30*b* may be engaged at the panel 61, e.g., via a flange 33. As can be seen, the bends 13 in the FIGS. 11 and 12 embodiment provide a liquid return path and a vapor supply path between the condenser and evaporator sections 10, 11.

Figure 13:
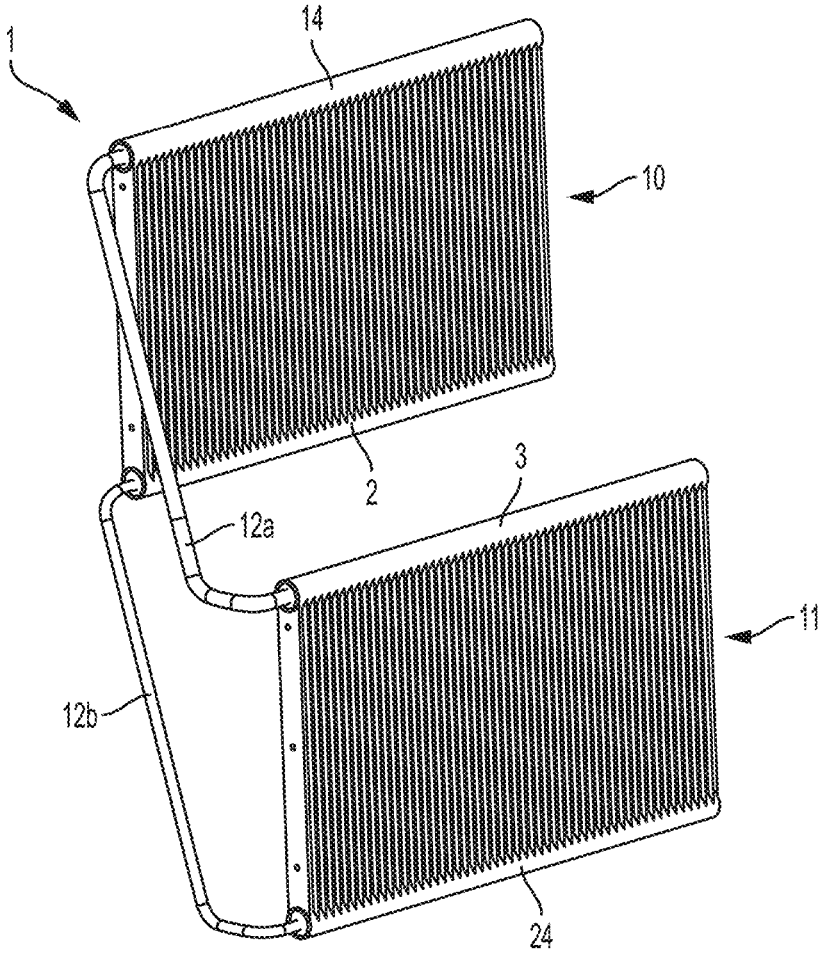
FIG. 13 shows an illustrative embodiment of a thermosiphon device with U-shaped connecting conduits.

FIG. 13 shows another illustrative embodiment of a thermosiphon device 10 that includes evaporator and condenser sections 11, 10 that each include channels extending between upper and lower headers, i.e., upper header 14 and lower header 2 for the condenser section 10 and upper header 3 and lower header 24 for the evaporator section 24. An upper conduit 12*a* fluidly couples the upper evaporator header 3 with the upper condenser header 14, e.g., to deliver vapor to the header 14. A lower conduit 12*b* fluidly couples the lower condenser header 2 with the lower evaporator header 24, e.g., to deliver liquid to the header 24. The conduits 12*a*, 12*b* may pass through a panel 61 or other portion of an enclosure 6, e.g., so that the evaporator section 11 is inside the enclosure 6 and the condenser section 10 is outside the enclosure 6. The conduits 12*a*, 12*b* may have a U-shape.

The embodiments provided herein are not intended to be exhaustive or to limit the invention to a precise form disclosed, and many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

What is claimed:

1. A thermosiphon device, comprising:

at least one multi-port tube including first and second ends and a plurality of channels each extending between the first and second ends, the multi-port tube having a bend between condenser and evaporator sections of the multi-port tube, the condenser section being between the first end and the bend of the multi-port tube and the evaporator section being between the second end and the bend of the multi-port tube;

at least one manifold in fluid communication with the first and second ends of the multi-port tube; and a panel arranged between the condenser and evaporator sections that defines a dividing point between portions inside of an enclosure and an environment outside of the enclosure, wherein the thermosiphon device is constructed and arranged such that heat is transferred between the evaporator section and the condenser section, through the panel, via flow of working fluid, wherein the condenser section and the evaporator section are connected only via the bend of a multi-port tube and the at least one manifold, wherein the thermosiphon device is adapted for flow of working fluid in which evaporated fluid flows upwardly in the evaporator section and to the condenser section via a vapor flow path, and condensed liquid flows downwardly in the condenser section and to the evaporator section via a liquid flow path, wherein the vapor flow path is different from the liquid flow path, and wherein the bend between the condenser and evaporator sections providing the vapor flow path to conduct fluid evaporated in the evaporator section to the condenser section or the liquid flow path to conduct condensed liquid from the condenser section to the evaporator section.

2. The device of claim 1, wherein the bend extends over at least 90 degrees.

3. The device of claim 1, wherein the bend extends over at least 180 degrees.

4. The device of claim 1, wherein the bend provides a vapor flow path to conduct fluid evaporated in the evaporator section to the condenser section.

5. The device of claim 1, wherein the bend provides a liquid flow path to conduct condensed liquid from the condenser section to the evaporator section.

6. The device of claim 1, wherein the device includes a single manifold that is connected to the first and second ends of the at least one multi-port tube.

7. The device of claim 1, wherein the at least one manifold includes first and second manifolds, the first manifold being connected to the first end and the second manifold being connected to the second end.

8. The device of claim 1, wherein the at least one multi-port tube is formed as a flat tube having a plurality of parallel flow channels.

9. The device of claim 8, wherein the at least one multi-port tube is bent about an axis that is perpendicular to a plane of the flat tube to form the bend.

10. The device of claim 9, wherein the at least one multi-port tube is additionally twisted about an axis that extends along a length of the flat tube.

11. The device of claim 1, comprising fins in thermal contact with the evaporator and/or condenser section of the multi-port tube.

12. The device of claim 1, comprising a plurality of multi-port tubes, wherein the device includes a single manifold that is connected to the first and second ends of the multi-port tubes, and wherein the first and second ends are arranged along a single line on the single manifold.

13. The device of claim 12, wherein the first and second ends alternate with each other.

14. The device of claim 1, wherein the bend between the condenser and evaporator sections provides a liquid flow path to conduct condensed liquid from the condenser section to the evaporator section, wherein the device includes first and second manifolds, the first manifold being connected to the first end of the multi-port tube and the second manifold being connected to the second end of the multi-port tube, and wherein at least one channel of the at least one multi-port tube is arranged to function as a vapor supply path to conduct evaporated fluid from the second manifold to the first manifold.

15. The device of claim 14, further comprising heat transfer structure in contact with a section of the evaporator section to overheat vapor in the vapor supply path.

16. The device of claim 1, further comprising a heat transfer structure in thermal contact with portions of the at least one multi-port tube other than portions which provide a vapor flow path or liquid flow path.

* * * * *